US010633228B2

(12) United States Patent
Münst et al.

(10) Patent No.: US 10,633,228 B2
(45) Date of Patent: Apr. 28, 2020

(54) CRANE

(71) Applicant: Liebherr-Components Biberach GMBH, Biberach an der Riß (DE)

(72) Inventors: Thomas Münst, Ummendort (DE); Gerhard Schmid, Wolpertswende (DE); Harald Wanner, Attenweiler (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 750 days.

(21) Appl. No.: 15/249,178

(22) Filed: Aug. 26, 2016

(65) Prior Publication Data

US 2016/0362283 A1 Dec. 15, 2016

Related U.S. Application Data

(63) Continuation of application No. PCT/EP2015/000436, filed on Feb. 25, 2015.

(30) Foreign Application Priority Data

Feb. 26, 2014 (DE) ..... 20 2014 001 801

(51) Int. Cl.

| | |
|---|---|
| ***B66C 23/94*** | (2006.01) |
| ***B66C 23/84*** | (2006.01) |
| ***B66C 23/88*** | (2006.01) |
| ***B66C 23/16*** | (2006.01) |

(52) U.S. Cl.

CPC ..... *B66C 23/94* (2013.01); *B66C 23/16* (2013.01); *B66C 23/84* (2013.01); *B66C 23/88* (2013.01)

(58) Field of Classification Search

CPC ..... B66C 23/02; B66C 23/022; B66C 23/16; B66C 23/163; B66C 23/84; B66C 23/86; B66C 23/88; B66C 23/94; B66C 13/28; B66C 15/00; F16D 2121/22

See application file for complete search history.

(56) References Cited

U.S. PATENT DOCUMENTS 9,327,950 B2 * 5/2016 Mayer ..... B66C 23/84

FOREIGN PATENT DOCUMENTS

| | | |
|---|---|---|
| CN | 102311058 | 1/2012 |
| CN | 203187324 | 9/2013 |
| CN | 103588103 | 2/2019 |
| DE | 956882 | 1/1957 |
| DE | 202012009167 | 1/2014 |
| EP | 1422188 | 2/2006 |
| EP | 2123590 | 11/2009 |
| EP | 2325400 | 5/2011 |
| EP | 2366837 | 9/2011 |
| EP | 2692883 | 2/2014 |
| JP | 2012-062189 | 3/2012 |
| WO | WO 2015/128086 | 9/2015 |

* cited by examiner

*Primary Examiner* — Michael R Mansen
*Assistant Examiner* — Juan J Campos, Jr.
(74) *Attorney, Agent, or Firm* — Levine Bagade Han LLP

(57) ABSTRACT

The present invention relates to a crane, in particular to a revolving tower crane, having a boom rotatable about an upright slewing gear axis by a slewing gear drive and having an out-of-operation brake which allows and brakes rotary movements of the boom in the out-of-operation state. In accordance with the invention, the out-of-operation brake is configured as working electrodynamically and comprises an electric motor of the slewing gear drive which can be operated as an electric-motor brake.

20 Claims, 6 Drawing Sheets

(b)

(a)

CRANE

CROSS-REFERENCE TO RELATED APPLICATIONS

This application is a continuation of International Patent Application No. PCT/EP2015/000436, filed Feb. 25, 2015, which claims priority to German Utility Model No. 20 2014 001 801, filed Feb. 26, 2014, issued May 27, 2015, both of which are incorporated herein by reference in their entireties.

BACKGROUND

1. Technical Field

The present invention relates to a crane, in particular to a revolving tower crane, having a boom rotatable about an upright slewing gear axis by a slewing gear drive and having an out-of-operation brake which allows and brakes rotary movements of the boom in the out-of-operation state.

2. Description of Related Art

The boom in revolving tower cranes, but also in other crane types, is rotatable about an upright slewing gear axis, with a slewing gear provided for this purpose being able to have a rotary drive, for example in the form of an electric motor, whose drive movement is converted into a rotary movement of the boom via a slewing gear transmission, for example in the form of a planetary gear. In this respect, in so-called top-slewers, the boom is rotated relative to the tower supporting the boom, whereas in so-called bottom slewers, the entire tower together with the boom supported thereat is rotated relative to the undercarriage or support base.

In crane operation, the rotary movements are controlled by a corresponding control of the rotary drive, with a slewing gear brake being provided for braking and also for a rotational fixing in a specific rotary position. Such slewing gear brakes can typically be configured for safety reasons such that the brake is preloaded into its braking operation position, for example by a corresponding spring device, and can be released by an adjustment actuator to release the rotatability.

In non-operation, or in the out-of-operation state when the crane is shut down, it is, however, desirable that the crane can rotate to be able to align itself with wind in the most favorable rotary position with respect to the respective wind direction. Since, for example, revolving tower cranes are typically much more stable, due to their ballast load, against tilt movements in the boom plane than in with respect to tilt movements transversely to the boom planes passing through the boom in a perpendicular manner, the crane should align itself under a strong wind such that the wind comes from behind and the boom is aligned with respect to the wind as parallel as possible with the direction of the wind since otherwise there would be a risk of a tilt of the crane or the crane would have to have additional ballast. To allow such an automatic alignment in the wind, a wind release apparatus is connectable/can be connected with the service brake or slewing gear brake and releases the brake, which is typically preloaded into its braking position, when the crane is out of operation. This "end of work" position of the slewing gear brake can be set by means of a manually actuable adjustment lever, but optionally also by a powered release drive which can move the brake actuator into a locked non-braking position before the crane is powered down. Document EP 14 22 188 B1, for example, shows such a wind release apparatus for the slewing gear brake of a revolving tower crane.

The free rotatability of the crane in the out-of-operation state can, however, result in instabilities of the crane due to self-rotation under unfavorable wind conditions. If the crane is, for example, between two buildings and only the boom or only the counter-boom is exposed to the wind, only the boom or only the counter-boom is respectively flowed against at one side by the wind, whereby the crane can be set into ever faster rotation since the crane does not come to a standstill when the boom has turned out of the wind or before the counter-boom has moved into the wind. The boom and the counter-boom can hereby alternately move into the wind so that a build-up of this cyclic wind action can result in an auto-rotation of the crane which causes the crane to rotate too fast and to tilt.

To avoid such an unwanted auto-rotation, it has already been proposed not to let the slewing gear rotate fully unbraked in the out-of-operation state, but rather to associate an additional brake with the slewing gear which admittedly allows the rotary movement of the crane under wind, but slightly brakes it to defuse the aforesaid auto-rotation problem. It has, for example, been considered to provide a light out-of-operation brake at the outlet of the slewing gear transmission which applies a limited braking torque against the crane rotation which is smaller than the torque produced by the wind action so that the crane can still align itself in the wind, but can only rotate at a low rotational speed.

Such an additional brake is, however, difficult to configure with respect to the braking torque to be equally suitable for different wind conditions and also for different crane positions. For example, too high a braking torque can have the result under a moderate wind that the crane does not align itself properly, while the same braking torque cannot sufficiently suppress said auto-rotation under very unfavorable wind conditions at high wind speeds. In addition, with revolving tower cranes having a luffable boom, the luffing position in which the crane was shut down can have an influence on the required braking torque.

SUMMARY OF THE INVENTION

It is therefore the underlying object of the present invention to provide an improved crane of the initially named kind which avoids disadvantages of the prior art and further develops the latter in an advantageous manner. An auto-rotation endangering the stability of the crane should also in particular be reliably prevented for changing, difficult wind conditions and different crane configurations on the shutting down of the crane, but with a free alignment of the crane in the wind simultaneously being made possible.

Said object is achieved in accordance with the invention by a crane in accordance with claim 1. Preferred embodiments of the invention are the subject of the dependent claims.

It is therefore proposed to use an electric motor of the slewing gear drive, which is used for rotating the crane in normal crane operation, as a slewing gear brake in the shut-down, out-of-operation state of the crane, with said slewing gear brake permitting the rotary movements under wind, but braking it. In accordance with the invention, the out-of-operation brake is configured as working electrodynamically and comprises an electric motor of the slewing gear drive which can be operated as an electric-motor brake. Although an electric motor typically requires an electrical power supply for its operability and in this regard appears unsuitable for the out-of-operation state of the crane as a functional component, a braking effect can nevertheless be produced which is actually best-suited for braking the crane movements under wind loads by operating the electric motor of the slewing gear as an electric-motor brake.

The braking torque can be adapted to the requirements and to the varying out-of-operation states by the electrodynamic configuration of the out-of-operation brake. A higher braking torque is produced if the conditions are such that there is a risk of the rotation of the crane building up to a dangerous auto-rotation. If the crane is, in contrast, not aligned sufficiently or is only slowly aligned in a preferred wind position, no braking torque or only a very small braking torque is produced. The out-of-operation brake is in particular configured as operating in dependence on the rotary speed such that the braking torque applied is larger at a higher rotational crane speed than at a lower rotational crane speed. If the crane does not rotate at all or if the crane aligns itself too slowly in the wind, there is not braking at all or only less powerful braking, whereas conversely braking is more powerful when the crane rotates too fast or starts to rotate too fast. The crane can hereby, on the one hand, always rotate in the most favorable alignment to the wind, while, on the other hand, an auto-rotation which is being built up is suppressed above the maximum rotary crane speed.

The out-of-operation brake can generally have different designs with respect to the speed dependence; for example, a uniform dependence, for example a proportional dependence, can be provided such that the braking torque continuously increases as the rotary crane speed increases.

Apart from this braking effect which is favorable for an out-of-operation brake of a crane, a wear-free operation can furthermore be achieved by the electrodynamically operating configuration of the slewing gear brake. Unlike multi-disk brakes or friction pad brakes in general, the electrodynamically operating out-of-operation brake remains permanently operable and the braking effect also does not drop over a longer time period. In addition, no space-grabbing and weight-inducing additional components such as mechanical brakes have to be used.

In a further development of the invention, a brake circuit can be connectable/can be connected with the electric motor of the slewing gear drive to increase and/or control the electric-motor braking resistance. At least one or more series resistances can in particular be connected into the electric slewing gear motor and the energy produced in electric-motor braking operation is dissipatively or thermally reduced at them.

Such a braking resistance connectable for the out-of-operation state can be a separate braking resistance not used in normal crane operation. A braking resistance can advantageously also be used as a series resistance for the out-of-operation brake function which can be switched onto the slewing gear drive in normal crane operation in order, for example, to take up the reverse power on the braking of the revolving deck. Advantageously, components already present per se are hereby also used in the out-of-operation state and take over a dual function.

To achieve a uniform braking effect over the different winding strands, said braking resistance can advantageously be configured as three-phase or can also comprise three resistance groups of at least approximately the same size with a single-phase configuration.

The electric motor can in particular be short-circuited for use as an out-of-operation brake. In this respect, a short-circuit switch which can be actuated manually or in a different manner can be provided for short-circuiting the motor winding of the electric motor. Depending on the design of the electric motor, an armature winding or rotor winding can, for example, be short-circuited here. A substantial portion, or the complete, braking power can advantageously be removed as heat in the motor itself by short-circuiting the motor winding. No specific additional components are required.

To avoid inadmissible heating of the electric motor in braking operation, in particular by the short-circuit current after a short-circuit, a cooling apparatus can be connectable/can be connected with the electric motor and can advantageously also be configured as a self-ventilator for cooling in the non-supplied state. A cooling fan driven by the speed of the electric motor can be used, for example.

It would, however, generally also be conceivable to reduce the electrical power arising in the electric-motor braking operation in a different manner, for example, at least partly by feeding it into an energy store, for example in the form of an on-board network battery or of a capacitor.

With the above-named short-circuit capability of the motor winding, series resistances can advantageously be connected to and/or can be part of the short-circuit switch so that they are activated or connected as series resistance on the short-circuiting. The resistance curve, that is the resulting braking torque, can be controlled or adapted in the desired manner through the speed of the electric motor. As the series resistance increases, the maximum braking effect can be shifted toward higher speeds, that is the characteristic braking torque curve over the speed becomes shallower or increases more slowly.

In particular the aforesaid switchable braking resistance can in this respect be used as the series resistance and can be configured as three-phase or can comprise three series resistance groups of approximately the same size.

Different measures can generally be taken to take account of the circumstance which arises in the out-of-operation state of the crane that no excitation voltage is available which can produce a magnetic field in the electric motor. In accordance with an advantageous embodiment of the invention, a permanently excited synchronous motor can be selected as the electric motor. Such a permanent excitation can, for example, be achieved by permanent magnets at the rotor, with other arrangements also being able to be considered, for example.

Such a permanently excited synchronous motor is in particular able to produce a braking torque in the out-of-operation state of the crane without an external power supply, said braking torque being able to be used for the dynamic braking of the rotary movement of the crane, for example of a revolving crane deck.

However, alternatively to such a permanently excited synchronous motor, the slewing gear drive can also comprise an asynchronous motor. This provides the advantage that with a crane which uses more than one electric motor, for example with more than one slewing gear, this plurality of motors can be operated at an inverter. The operation of a plurality of electric motors at an inverter is not possible with synchronous motors.

Since such asynchronous motors cannot be magnetized either by the inverter or by a supply network with a shut-down power supply—which is typically the case in the out-of-operation state of the crane-out-of-operation excitation means can be connectable/can be connected with the asynchronous motor to be able also to magnetically excite the asynchronous motor in the out-of-operation state of the crane. These out-of-operation excitation means 15 can in particular comprise a capacitor excitation. Such a capacitor excitation can in particular comprise the parallel connection of capacitors to the stator winding of the asynchronous motor.

The electric motor can in particular be configured as a self-excited asynchronous generator.

The required idle power for magnetization can be provided to the asynchronous motor in the out-of-operation state of the crane by means of said capacitors which can be connected. A parallel connection of the stator winding and capacitor can in particular form to resonant circuit. The capacitors can in this respect be connected both in a star and in a triangle, with it in particular having, proved itself to connect the capacitors in a triangle.

BRIEF DESCRIPTION OF THE FIGURES

The invention will be explained in more detail in the following with respect to preferred embodiments and to associated drawings. There are shown in the drawings.

DETAILED DESCRIPTION

Figure 1:
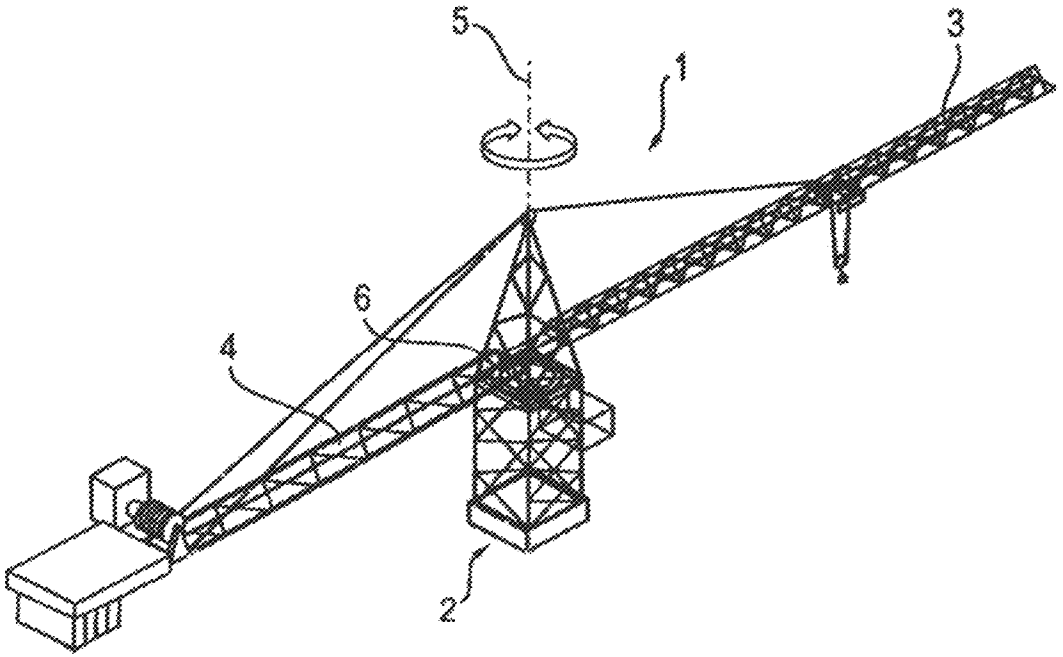
FIG. 1: a perspective, portion-wise representation of a revolving tower crane in accordance with an advantageous embodiment of the invention which is configured as a top-slewer and which has a slewing gear for rotating the boom relative to the tower.

As FIG. 1 shows, the crane forming the object can be a revolving tower crane 1 configured as a so-called top-slewer whose tower 2 supports a boom 3 and a counter-boom 4 which extend substantially horizontally and which are rotatable about the upright tower axis 5 relative to the tower 2. Instead of the crane configuration shown in FIG. 1, the revolving tower crane 1 can, however, also be configured as a bottom-slewer and/or can comprise a luffable, pointed boom and/or can be guyed via a guying with respect to the tower foot or the superstructure.

To be able to rotate the boom 3, a slowing gear 6 is provided which is provided in the embodiment shown at the upper end of the tower 2 between the boom 3 and the tower 2 and which can comprise a sprocket with which a drive wheel driven by a drive motor 7 can mesh.

An advantageous embodiment of the drive device of the slewing gear 6 can comprise an electrical drive motor 7 which can drive a drive shaft via a slewing gear transmission. Said slewing gear transmission can, for example, be a planetary gear to step the speed of the drive motor 7 up/down into a speed of the output shaft in a suitable manner.

To be able to brake rotary movements of the boom 3 in crane operation and/or to be able to maintain a rotary position of the boom 3 which has been moved to, the slewing gear 6 comprises a slewing gear service brake which can, for example, be arranged on the input side of the slewing gear transmission. The service brake can comprise, for example, in a manner known per se a frictional disk brake device or a multi-disk brake device which is preloaded into the braking position by a preloading device and which can be lifted by an electric adjustment actuator in the form of an electric magnet, for example, to release the brake. Alternatively or additionally to such a mechanical service brake, an electric-motor service brake can also be provided, for example in the form of a brake chopper having connectable braking resistances which can be integrated into or connectable/can be connected with the inverter controlling the electric motor 2, cf. FIGS. 4, 5 and 6.

In addition to this service brake, the slewing gear 6 comprises an out-of-operation brake 10 which is intended to brake, but to allow, the rotary movements of the boom 3 in the shut-down out-of-operation state of the crane in order to enable a self-alignment of the crane or of its boom 3 under wind loads.

Said out-of-operation brake 10 is configured as operating electrodynamically and comprises the drive or electric motor 7 of the slewing gear 6, which electric motor 7 can be operated as the electric-motor brake.

Figure 2:
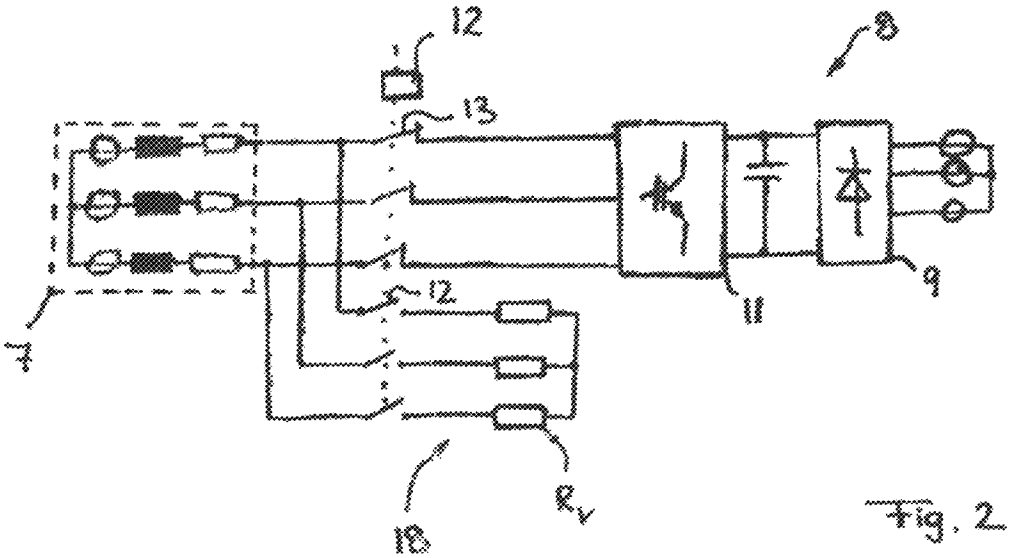
FIG. 2: an electrical equivalent circuit diagram of an electric motor of the slewing gear drive which is configured as a permanently excited synchronous motor and of the short-circuit switch with series resistances associated therewith.

As FIG. 2 shows, said electric motor 7 can in particular be configured as a permanently excited synchronous motor which can be supplied and controlled by an inverter 8. Said inverter 8 can comprise a rectifier 9 and an inverted rectifier 11, cf. FIG. 2, via which the supply voltage can be output to the electric motor 7.

To generate the desired braking torque in the out-of-operation state, a short-circuit switch 12 can be connectable/can be connected with the electric motor 7 and the windings of the electric motor 7 can be short-circuited by means of it.

Said short-circuit switch 12 can be connected to a line disconnector 13 by means of which the electric motor 7 can be disconnected from the supply network on the taking out of operation. Said short-circuit and line disconnection switches 12 and 13 can be integrated into a common switch so that only one switch has to be actuated on the taking out of operation. Alternatively, however, separate switches can also be provided which can be separately operable or which can advantageously be connected to one another such that an actuation of the one switch simultaneously actuates the other switch, preferably such that the electric motor is short-circuited simultaneously or offset in time on the disconnection of the electric motor 7 from the supply network.

As FIG. 2 shows, series resistances $R_v$ can be connectable/connected with the short-circuit switch 12 which can be configured as three-phase and which can be connectable/connected with the motor winding in individual phases when the motor is short-circuited. In general, however, a pure short-circuit switch can also be used without such a series resistance.

As FIG. 3*a* shows, the electric motor 7 produces a torque or braking torque varying with the speed in the short-circuited state. If the crane is rotated by the wind, for example, the electric motor 7 undergoes a corresponding rotation or speed which rises and falls with the wind-induced rotational speed of the crane. As FIG. 3*a* shows, on a lack of any rotational speed, no electrodynamic braking torque at all is initially produced, that is the crane can rotate freely—in more precise terms, while only overcoming the mechanical drag resistance. If the rotary speed increases, the braking torque produced electrodynamically by the electric motor 7 also rises progressively until it drops again at the characteristic tilt speed $\eta_{Kipp}$.

Figure 3:
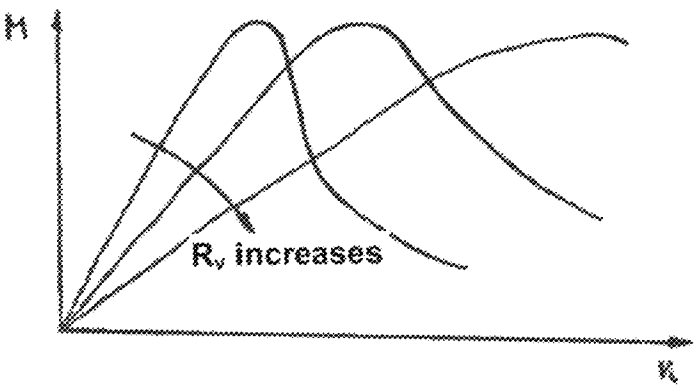
FIG. 3: a characteristic of the braking torque which can be generated by the electric motor of FIG. 2 over the motor speed when the synchronous motor of FIG. 2 is in the short-circuited state, with the part-view FIG. 3*a* showing the characteristic curve without series resistances connected in short-circuit and with the part-view FIG. 3*b* showing the characteristic curves for different series resistances connectable during the short-circuiting.
Figure 3:
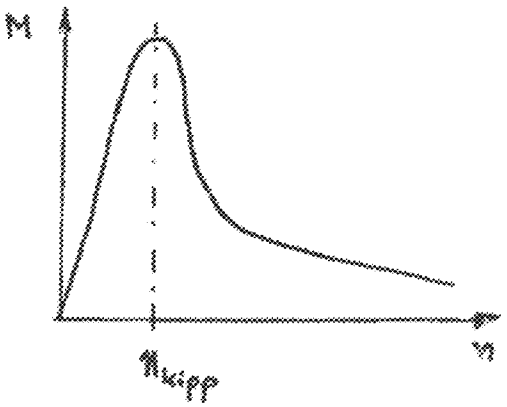

As FIG. 3*b* shows, the development of the braking torque curve over the speed can be varied or controlled by switching in the series resistances $R_v$ shown in FIG. 2. The greater the series connected series resistances $R_v$ are, the shallower the increase in the braking torque curve, cf. FIG. 3, so that the maximum braking torque is only reached at a higher speed. The electrodynamically provided braking torque can accordingly be controlled in the desired manner in dependence on the speed by a selection of the series resistance or resistances. While it will be sufficient for a number of cranes only to be able to switch in a series resistance or a series resistance group on the short-circuiting, provision can also be made in a further development of the invention that the crane operator can switch in braking resistances of different magnitudes and can select which of a plurality of braking resistances is activated or connected thereto, for example in that a plurality of short-circuit switches having respectively connectable/can be connected braking resistances can be closed.

Figure 4:
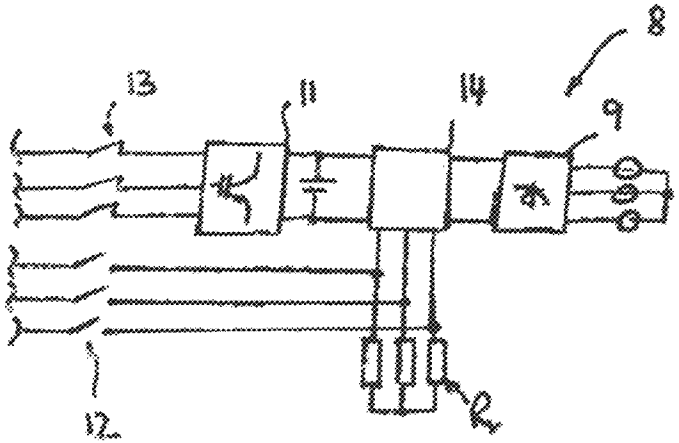
FIG. 4: an electrical equivalent circuit diagram of a permanently excited synchronous motor similar to FIG. 2, with the braking resistances of a brake chopper present in the inverter circuit being used as series resistances switchable during the short-circuiting.
Figure 5:
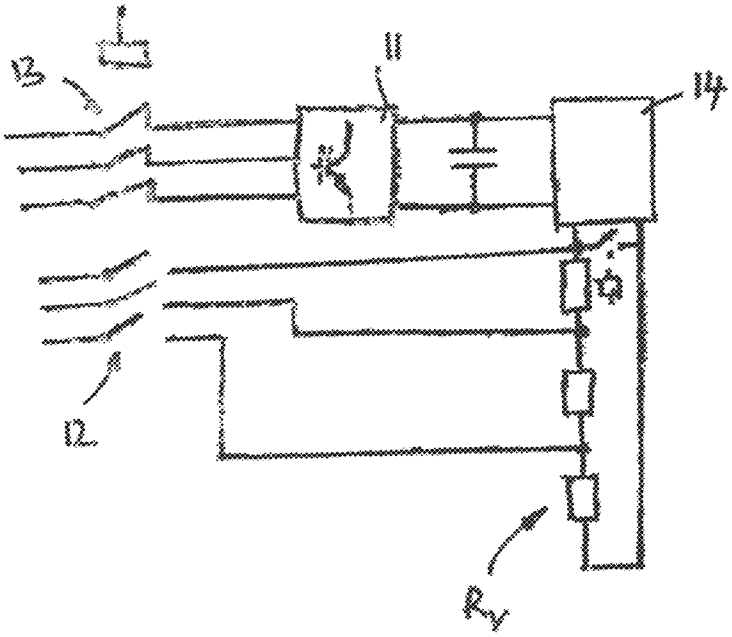
FIG. 5: an electrical equivalent circuit diagram of the braking resistances which can be connected as series resistances during the short-circuiting similar to FIG. 4, with the braking resistance not being configured as three-phase, but comprising three resistance groups of approximately equal size with a single-phase configuration.

As FIG. 2 shows, the series resistances $R_v$ can be separate resistances only provided for the out-of-operation brakes. Alternatively to this, however, an existing braking resistance can also advantageously be used as the series resistance $R_v$ which takes up the reverse power in normal crane operation, that is in the operating state, on the braking of the rotary movement of the revolving deck, for example. As FIG. 4 shows, such a braking resistance can be connectable/connected with a brake chopper which can be provided in the inverter circuit 8. Such a braking resistance can preferably already be of three-phase design, cf. FIG. 4 or can comprise at least approximately three resistance groups $R_1$, $R_2$, $R_3$ of equal sizes with a single-phase design, cf. FIG. 5.

Figure 6:
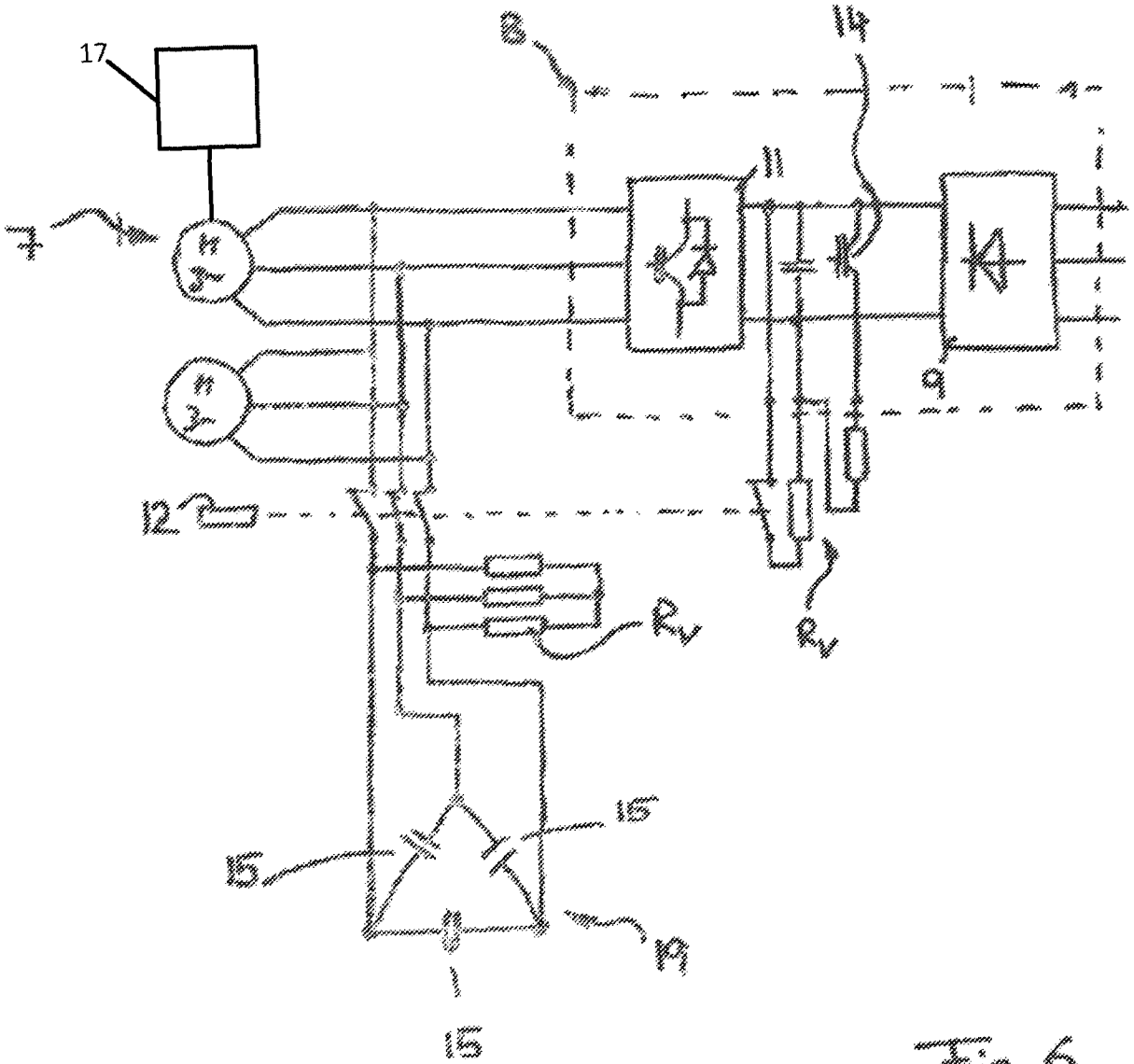
FIG. 6: an electrical equivalent circuit diagram of a slewing gear drive having two asynchronous motors which can be operated by a common inverter, with capacitors being connected in parallel for the magnetic self-excitation of the asynchronous motors.

The slewing gear 6 can also comprise one or more asynchronous motors as the electric motor 7 instead of a permanently excited synchronous motor, cf. FIG. 6. Such a plurality of asynchronous motors can advantageously be operated by a common inverter 8, with the inverter circuit in this respect being able to comprise a rectifier 9 and an inverter module 11 in manner known per se, with a brake chopper 14 having connectable/can be connected braking resistances Rv (a braking circuit) also being able to be provided here by which rotary movements can be braked in normal crane operation.

Since such asynchronous motors lack the magnetic excitation in the out-of-operation state without the operating network voltage supply per se, excitation capacitors 15 (a capacitor circuit) can be switched into the asynchronous motors 7, for example via an out-of-operation switch 16. As FIG. 6 shows, the excitation capacitors 15 can advantageously be connected in a triangle and can be switched in parallel. Load resistances can advantageously be connectable/can be connected with the switchable excitation capacitors 15, cf. FIG. 6.

The asynchronous motors 7, which operate as an out-of-operation brake, obtain the required idle power for magnetization required in generation operation from said excitation capacitors 15. In this respect, the idle current, and thus the magnetization, also increases as the speed or frequency rises. The voltage in the three-phase system likewise increases, which results in an increasing power take-up. All the components in the system are in this respect designed for the highest voltage to be assumed.

To avoid inadmissible heating of the electric motor in braking operation, in particular by the short-circuit current after a short-circuit, a cooling apparatus 17 can be connectable/can be connected with the electric motor and can advantageously also be configured as a self-ventilator for cooling in the non-supplied state. A cooling fan driven by the speed of the electric motor can be used, for example.

We claim:

1. A revolving tower crane comprising:

a boom rotatably supported about an upright axis of rotation by a slewing gear drive, wherein the boom comprises an out-of-operation brake which permits and brakes rotary movements of the boom in an out-of-operation state of the crane under wind loads, wherein the out-of-operation brake is configured to operate electrodynamically, and wherein the out-of-operation brake comprises an electric motor of the slewing gear drive which is operable as an electric-motor brake, wherein the electric motor is configured as an asynchronous motor with which an out-of-operation exciter is connected thereto, and wherein the out-of-operation exciter comprises a capacitor circuit.

2. The crane of claim 1, further comprising a brake circuit connected with the electric motor of the slewing gear drive.

3. The crane of claim 2, wherein the brake circuit comprises at least one series resistance ($R_v$) which can be activated or connected thereto.

4. The crane of claim 3, wherein the series resistance ($R_V$) which can be activated is configured as three-phase or comprises three resistance groups of at least approximately the same size with a single-phase configuration.

5. The crane of claim 3, wherein the series resistance ($R_V$) which can be activated comprises a braking resistance which can be activated in normal operation for taking up a reverse power produced in crane operation.

6. The crane of claim 5, wherein the series resistance ($R_V$) which can be activated is configured as three-phase or comprises three resistance groups of at least approximately the same size with a single-phase configuration.

7. The crane of claim 2, wherein the brake circuit comprises a short-circuit switch for short-circuiting a motor winding of the electric motor.

8. The crane of claim 1, wherein the capacitor circuit comprises excitation capacitors switchable in parallel with the winding of the asynchronous motor and connected to one another in a star or in a triangle.

9. The crane of claim 1, wherein the out-of-operation brake is configured such that the braking torque is smaller than a predefined torque up to a predefined rotational speed of the boom, said predefined torque being able to be produced by a predefined wind load on the crane and the braking torque only being larger than the predefined torque produced by said wind load on the crane on an exceeding of said rotational speed of the boom.

10. The crane of claim 1, further comprising a cooling apparatus active in electric-motor braking operation, wherein the cooling apparatus is connected with the electric motor.

11. A revolving tower crane comprising:

a boom rotatably supported about an upright axis of rotation by a slewing gear drive, wherein the boom comprises an out-of-operation brake which permits and brakes rotary movements of the boom in an out-of-operation state of the crane under wind loads, wherein the out-of-operation brake is configured to operate electrodynamically, and wherein the out-of-operation brake comprises an electric motor of the slewing gear drive which is operable as an electric-motor brake, wherein the electric motor is configured as an asynchronous motor with which an out-of-operation exciter is connected thereto, wherein the out-of-operation exciter comprises a capacitor circuit, and wherein the capacitor circuit comprises excitation capacitors switchable in parallel with the winding of the asynchronous motor and connected to one another in a star or in a triangle.

12. The crane of claim 11, further comprising a brake circuit connected with the electric motor of the slewing gear drive.

13. The crane of claim 12, wherein the brake circuit comprises at least one series resistance ($R_v$) which can be activated or connected thereto.

14. The crane of claim 13, wherein the series resistance ($R_V$) which can be activated is configured as three-phase or comprises three resistance groups of at least approximately the same size with a single-phase configuration.

15. The crane of claim 13, wherein the series resistance ($R_V$) which can be activated comprises a braking resistance which can be activated in normal operation for taking up a reverse power produced in crane operation.

16. The crane of claim 15, wherein the series resistance ($R_V$) which can be activated is configured as three-phase or comprises three resistance groups of at least approximately the same size with a single-phase configuration.

17. The crane of claim 12, wherein the brake circuit comprises a short-circuit switch for short-circuiting a motor winding of the electric motor.

18. A revolving tower crane comprising:

a boom rotatably supported about an upright axis of rotation by a slewing gear drive, wherein the boom comprises an out-of-operation brake which permits and brakes rotary movements of the boom in an out-of-operation state of the crane under wind loads, wherein the out-of-operation brake is configured to operate electrodynamically, and wherein the out-of-operation brake comprises an electric motor of the slewing gear drive which is operable as an electric-motor brake, and a cooling apparatus active in electric-motor braking operation, wherein the cooling apparatus is connected with the electric motor.

19. The crane of claim 18, further comprising a brake circuit connected with the electric motor of the slewing gear drive.

20. The crane of claim 18, wherein the out-of-operation brake is configured such that the braking torque is smaller than a predefined torque up to a predefined rotational speed of the boom, said predefined torque being able to be produced by a predefined wind load on the crane and the braking torque only being larger than the predefined torque produced by said wind load on the crane on an exceeding of said rotational speed of the boom.

* * * * *